United States Patent [19]

Van Sickle

[11] 4,301,732

[45] Nov. 24, 1981

[54] TRACER BULLET

[76] Inventor: Norman E. Van Sickle, 6 N. 1st, Council Bluffs, Iowa 51501

[21] Appl. No.: 50,257

[22] Filed: Jun. 20, 1979

[51] Int. Cl.[3] ..... F42B 13/34

[52] U.S. Cl. ..... 102/430; 102/513

[58] Field of Search ..... 102/6, 60, 66, 87, 90, 102/92.1, 92.2, 92.3, 92.4, 92.5, 92.6, 92.7; 42/1 N; 149/72

[56] References Cited

U.S. PATENT DOCUMENTS

| | | | |
|---|---|---|---|
| 684,653 | 10/1901 | Tubini | 102/60 |
| 694,032 | 2/1902 | Semple | 102/60 |
| 1,301,380 | 4/1919 | Buckingham | 102/87 |
| 2,381,474 | 8/1945 | Turnbull | 102/60 |
| 3,111,899 | 11/1963 | Tiedemann | 102/87 |
| 3,983,818 | 10/1976 | Ciccone | 102/60 |
| 3,991,682 | 11/1976 | Peak | 102/92.1 |

*Primary Examiner*—Richard E. Schafer
*Assistant Examiner*—Edward F. Miles
*Attorney, Agent, or Firm*—Henderson & Sturm

[57] ABSTRACT

An ammunition cartridge, having a projectile element secured to a shell which is loaded with a charge of powder and includes an ignition primer and a dessicant, is modified to include a cylindrical magnesium element extending downwardly from the projectile into the shell, the magnesium element has a cylindrical cavity in its lower portion which houses a substantially cylindrical pyrotechnic element, the pyrotechnic element is held in close proximity to the powder charge and ignites as the charge explodes and discharges the projectile, the burning pyrotechnic material creates a bright light which, because of openings in the magnesium element, can be seen through a theodolite by a surveyor at a remote point, the burning pyrotechnic element in turn ignites the magnesium element which also gives off a bright light when burning, that light also being observable from a remote point, the bright lights from these burning elements combining to produce a mementary vertical streak of predetermined height, the streak being aligned with the vertical crosshair of surveyor's transit positioned at a remote point.

2 Claims, 5 Drawing Figures

TRACER BULLET

BACKGROUND OF THE INVENTION

The present invention relates generally to surveying, and more particularly, to a tracer bullet for use in vertical projection surveying. Vertical projection surveying is designed to be used in areas where survey points are not visible from one another such as in hilly terrain or wooded areas. Essentially, it entailes projecting from a hidden survey point to an observable point located vertically above the hidden point.

Three methods have been employed in vertical projection surveying:

The first is the Hoversight Method, developed by the U.S. Geological Survey, which utilizes a flashing target, mounted to a helicopter, and positioned directly above a hidden survey point. This method requires the coordination of the helicopters with ground crews and computers and is obviously quite costly.

The second method is the U.S. Forest Service's Lazer Range Pole which directs a vertical column of light above a hidden survey point. The column is visable through a specially designed theodolite located at a remote survey point. A major drawback of this method is its cost which is currently quoted at approximately $92,000 per unit.

The third method, which utilizes the vertical projection of a trace, is employed with the present invention. This method is described in U.S. Pat. No. 3,350,783 which is hereby incorporated by reference. Utilizing this method, the applicant's tracer bullet is fired vertically and leaves a momentary trace which is viewable from a remote survey point through a surveyor's transit. The tracer bullet is differentiated from military type tracer bullets, the trace from which can only be seen from behind by the person who fired the bullet. The instant tracer bullet also improves over others in that it includes the addition of a desiccant, silica gel kernels, to the gunpowder in the shell. The silica kernels substantially prolong the shelf life of the bullet by binding the moisture within the shell and thereby allowing the oxygen within the pyrotechnic to be available for combustion. The use of the applicant's tracer bullet with the vertical projection method is less costly in equipment and materials, and saves considerable time over other vertical projection survey methods.

SUMMARY OF THE INVENTION

The present invention is a tracer bullet to be used in vertical projection surveying applications. The bullet is discharged from a pistol (usually a colt or ruger 45) which is mounted to shoot tracer bullets vertically; the traces, or streaks, being sighted through a surveyor's transit, or theodolite. The apparatus for mounting and aligning the pistol in a vertical orientation is described in my copending application Ser. No. 871,293 which is hereby incorporated by reference. The instant tracer bullet leaves a momentary streak which is visible from the side, and depending on the particular bullet used, is visible up to heights of 300 ft. to 600 ft. It is thus equivalent to a surveyor's range pole up to 600 feet high.

In the preferred embodiment, a 45 caliber bullet is modified to include a magnesium element which extends downwardly from the projectile element or slug, and into the shell of the asembled cartridge. The lower portion of the magnesium element houses a pyrotechnic material which is held in close proximity to the charge of powder in the shell. The explosion of the charge ignites the pyrotechnic while it discharges the projectile. The pyrotechnic, in turn, ignites the magnesium element. Openings are provided in the magnesium element to ensure that the bright light created by the burning of these elements can be seen from the side such as by a surveyor sighting through a theodolite at a remote point. The projectile, thus, leaves a highly visible trail, or streak.

The instant bullet also includes the addition of silica gel kernels, 2 or 3 of which are loaded into the shell with each charge of gunpowder to serve as a desiccate and absorb any moisture, or water, within the shell. This prevents any moisture which is trapped within the shell during loading from combining, over time, with the oxygen in the pyrotechnic; thus making that oxygen unavailable for combustion, and rendering the tracer bullet ineffective, and capable of producing only an inferior trace. Hence, the provision of a desiccant such as silica gel substantially prolongs the shelf life of the bullet.

The projectile of the tracer bullet embodiment, furthermore, is designed so that it is concentrically balanced to travel in a straight path; is of sufficient weight and design so as not to be pulled off its vertical path by transverse winds; travels at a speed whereat the trace is conveniently observed through a theodolite by a surveyor; and provides a streak to a predetermined height and then continues upward some 2,000 ft. to ensure that it is cool, and not a fire hazard, when it returns to the ground.

It is therefore an object of the present invention to provide a tracer bullet for use in vertical projection surveying that creates a momentary trace which is visible from a direction perpendicular to the path of the projectile.

A further object is to provide a tracer bullet which is designed to travel in a straight vertical line.

A still further object is to provide a tracer bullet which includes a desiccant compound within the loaded shell to prolong the shelf life of the bullet by preventing moisture from combining with the oxygen in the pyrotechnic.

Still another object is to provide a tracer bullet which creates a streak to a predetermined height and then falls to the earth in a cooled state.

Still another object is to provide a tracer bullet which when used in vertical projection surveying is considerably less expensive than, and saves considerable time over other vertical projection surveying techniques.

These and other objects, advantages and novel features of the present invention will become apparent from the following detailed description of the invention when considered in conjunction with the accompanying drawings.

DESCRIPTION OF THE PREFERRED EMBODIMENT

Figure 1:
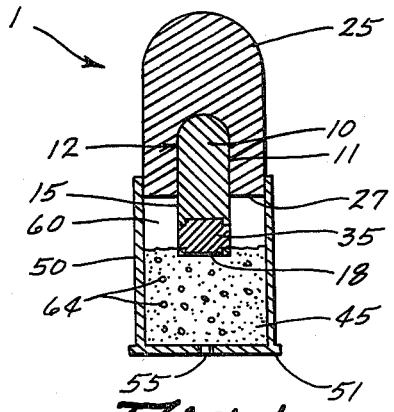
FIG. 1 is an elevational cross-sectional view of the tracer bullet of the instant invention.

The present invention comprises a tracer bullet suitable for producing a momentary streak of light, or trace, in the path of the projectile. The bullet 1 is essentially comprised of a projectile element 25 with a combustible insert 10, here magnesium, the magnesium insert 10 houses a pyrotechnic material 35, the projectile 25 is press fitted onto a cartridge shell 50 which contains a charge of powder 55, and silica gel particles 64 are mixed in with the powder 55 for a purpose later described. See FIG. 1.

In the preferred embodiment disclosed herein, the tracer bullet is described, essentially, as a modification of a typical 45-caliber cartridge. It is to be understood, however, that the teachings of the invention are applicable to virtually any round of ammunition.

Figure 2:
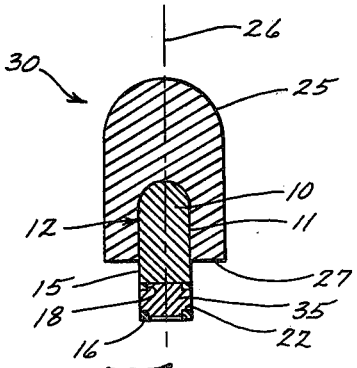
FIG. 2 is an elevational cross-sectional view of the projectile-magnesium element-pyrotechnic subassembly of the tracer bullet.

As shown in FIGS. 1 and 2, the magnesium element 10 has an upper portion 12 which is pressed into and housed within the projectile 25, and a lower portion 15 extending from the downward side 27 of the projectile 25. Lower portion 15 has a concentric bore, or cylindrical cavity 18 (see FIG. 4) which is filled with a pyrotechnic material 35. (See FIG. 3) Cavity 18 is defined by cylindrical wall 20 which has circular openings 22. Openings 22 permit the trace to be seen from the side at a remote point as will later be described. As is apparent from FIG. 4, cavity 18 can be formed by drilling a concentric hole vertically up into element 10; then openings 22 can be formed by drilling horizontally through the element 10.

To load the pyrotechnic material 35 into cavity 18, magnesium element 10 is enclosed in a die and inverted with relation to the drawings. Powdered pyrotechnic material is loaded into cavity 18, the openings 22 being sealed by the walls of the die. A plunger (not shown), dimensioned to fit within ring 16 is brought into contact with the powdered material and seals the cavity 18. Pressure is applied via the plunger so that the pyrotechnic material is compressed into cavity 18. In this compressed form the pyrotechnic material 35 has a bottom surface 38 which is somewhat higher than ring surface 16 in FIG. 3. The plunger also forces the pyrotechnic powder to be extruded into circular openings 22 and against the die walls. Consequently, when the die is removed, the surface of the pyrotechnic material at openings 22 is continuous, or flush, with the exterior surface 11 of magnesium element 10. This extrusion causes the substantially cylindrical pyrotechnic element 35 to have raised disc portions 37.

The pressure utilized to compress the pyrotechnic material 35 must be sufficiently great to ensure that the pressure from the explosion of charge 45 doesn't blow the material 35 out of cavity 18. It has been determined that a pressure of $2\frac{1}{2}$ times the pressure of explosion is suitable to secure pyrotechnic 35 within element 10 against the explosion. This pressure packing also ensures that the pyrotechnic material 35 burns progressively as the projectile 25 travels in its vertical flight.

With pyrotechnic element 35, thus, secured within magnesium element 10, and the element 10 secured to projectile 25 as described above, this subassembly 30, see FIG. 2, is affixed to a cartridge shell 50 as shown in FIG. 1. Shell 50 has been loaded with a charge of gunpowder 45, and includes an ignition primer 55 which is located at the radial center of circular bottom 51. In loading assembly 30 onto the shell 50 an air space 60 is created between the powder 45 and subassembly 30. Air from the loading environment is trapped within air space 60. The air contains the humidity of the environment, and thus, moisture, or water, is trapped within air space 60. Water has an affinity for the oxygen in the pyrotechnic, and where barium peroxide is utilized, the water, over time, will bind the oxygen of the barium peroxide, rendering the pyrotechnic ineffective and capable of producing only an inferior streak. That result ensues because of the fact that there would be very little oxygen available for the combustion necessary to produce a trace. Consequently, unless the pyrotechnic is protected from moisture intrusion, the shelf life of the bullet is greatly impaired.

The present invention employs the provision of a desiccant, specifically silica gel, within the shell to solve this problem. During loading, silica gel kernels 64, 2 or 3 for each bullet, are dispersed in the gunpowder 45. The silica kernels 64 have a higher affinity for water than pyrotecnic materials such as barium peroxide, and hence, they fix all moisture within the shell, ensuring that the oxygen of the pyrotechnic is available for combustion. Note that inasmuch as a 45-caliber bullet travels at 750 ft/sec, a vacuum is produced on its downward side. Therefore, oxygen for combustion is not available from surrounding air when the projectile 25 is in flight. Hence, a compound such as barium peroxide is employed to provide a source of oxygen within the pyrotechnic itself.

Projectile 25 is symmetric in exterior surface configuration, mass, and weight distribution about vertical axis 26 so that its center of gravity lies on the axis 26. This symmetry and concentric balancing ensure a straight and unwavering trace. The 45-caliber projectile 25 is of sufficient mass and weight so as not to be blown from a straight vertical path by any winds.

Bullet 1 is designed to provide a highly visible trace up to a predetermined height. The length of the trace is controlled by varying the amount of pyrotechnic material 35 employed. When the pyrotechnic is consumed, no more oxygen is available for combustion, and the trace ends. Although the trace ends, however, projectile 25 continues its vertical flight a substantial distance so that it returns to the ground in a cooled state and is not a fire hazard. For example, a bullet designed for a 600 ft. trace will reach an altitude of approximately 2500 ft. before returning to the ground. And in returning to the ground, although the projectile 25 will reach terminal velocity, it will normally fall end over end which slows the fall velocity such that it would most likely not seriously injure a person should it happen to strike someone.

The bullet 1, in its preferred embodiment, is designed to travel with a vertical velocity which permits convenient viewing by surveyors through a theodolite. The vertical air speed of a 45-caliber bullet is 750 ft/sec. which is suitable for this purpose.

In accordance with the above description the invention operates as follows:

The bullet 1 is loaded into a 45-caliber pistol which is secured in a vertical orientation over a hidden survey point by means of the apparatus described in my copending application identified earlier and incorporated there by reference. One or more surveyors are stationed at remote survey points and have oriented their theodolites in the direction of the hidden point to observe the trace. With surveyors at the various points in radio contact, the hidden point surveyors count down to the firing of a shot so that the remote point surveyors can view the momentary streak through their theodolites.

When the gun is fired the streak is produced in the following way:

The primer 55 ignites the powder 45 which explodes, discharging the projectile 25 vertically and igniting the pyrotechnic material 35 which, in turn, lights the magnesium element 10.

Figure 3:
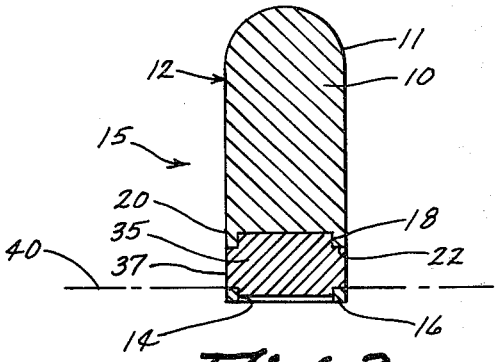
FIG. 3 is an enlarged elevational cross-sectional view of the magnesium element and the pyrotechnic material housed therein.
Figure 4:
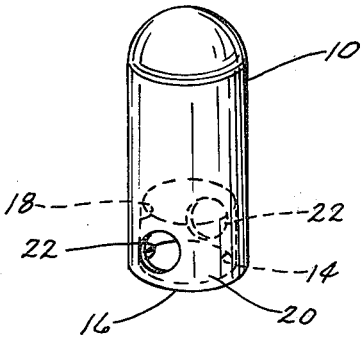
FIG. 4 is a perspective view of the magnesium element of the instant invention.
Figure 5:
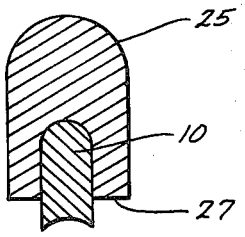
FIG. 5 is an elevational cross-sectional view of a typical projectile element once having returned to the ground after producing a streak showing that the pyrotechnic material and all portions of the magnesium element proximate thereto are burned away.

The burning of the pyrotechnic 35 produces a bright light as does the burning of the magnesium 10. The pyrotechnic 35 ignites immediately from the explosion while the magnesium lights a fraction of a second or so later in time. The projectile 25 will, thus, travel some vertical distance before the magnesium 10 ignites. With reference to FIG. 3 it can be seen that the pyrotechnic will burn virtually instantaneously at explosion to a point above line 40, and thus will emit bright light through openings 22 from the start of the travel of the projectile 25. And inasmuch as the projectile 25 will spin in flight, this light can be seen from any direction perpendicular to the path of projectile 25. With the lapse of a fraction of a second or so, the magnesium element 10 will ignite and produce a second bright light which can be seen from the side as the exterior surface of the magnesium element 10 burns, or through openings 22. FIG. 5 shows a typical projectile 25, once fired, after having returned to the ground. In producing the trace, the pyrotechnic element, and portions of the magnesium element proximate thereto are burned away, and emit light radially. Hence, a surveyor positioned at a remote point located in a direction perpendicular to the path of projectile 25 can observe the momentary trace through a theodolite, or surveyors transit. This trace is differentiated from the trace left by a military tracer bullet which can only be seen from behind by the person firing the bullet.

Once having observed the trace the surveyor will align the vertical crosshair of the theodolite with it. Normally, with some experience, this can be done after 3 or 4 traces. Radio contact is essential so that the surveyor/observer knows exactly when the shots will be fired. When the alignment is achieved, the surveyor knows his transit is oriented directly at the hidden survey point and can record the necessary data, and perform the calculations required for triangulation surveying.

Having thus disclosed my invention it is obvious that many modifications and variations of the present invention are possible in light of the above teachings. It is therefore to be understood that, within the scope of the appended claims, the invention may be practiced otherwise than as specifically described.

I claim:

1. In a firearm cartridge having a shell, a charge of powder for a firearm in said shell, and a primer means for detonating said powder; a tracer bullet comprising:

(a) a projectile element secured to said shell, said projectile element having a recessed portion formed into the lower end thereof;

(b) a combustible element having an upper portion which is housed within said recessed portion of said projectile element, and further having a lower cylindrically shaped portion, said lower cylindrical portion including a concentric bore;

(c) a pyrotechnic element, said pyrotechnic element being substantially cylindrical and being housed within said concentric bore, said concentric bore being defined by a cylindrical wall, said cylindrical wall including openings, each of said openings being filled with a corresponding raised portion extending from said substantially cylindrical pyrotechnic element; and (d) a desiccant deposited within said shell, said shell including an air space and said desiccant absorbing an amount of moisture from said air space so that said moisture does not combine with oxygen in said air space; wherein said powder is ignitable by said primer means to cause an explosion, said explosion causing the discharge of said projectile from said shell and substantially simultaneously causing said pyrotechnic element to burn, said windows of said combustible element comprising a means for viewing said burning pyrotechnic element from a distant point, said burning pyrotechnic element causing said combustible element to burn, where by said burning pyrotechnic and combustible element produce a trace visable from a distant point.

2. The tracer bullet as described in claim 1 wherein said desiccant comprises one or more silica gel kernels which are mixed in with said powder within said shell.

* * * * *